US005383649A

United States Patent [19]

Forrest

[11] Patent Number: 5,383,649

[45] Date of Patent: Jan. 24, 1995

[54] DEVICE FOR INTRODUCING PARTICULATE MATERIAL

[75] Inventor: James Forrest, Swansea, United Kingdom

[73] Assignee: Osprey Metals Limited, United Kingdom

[21] Appl. No.: 956,900

[22] PCT Filed: Jul. 17, 1991

[86] PCT No.: PCT/GB91/01189

§ 371 Date: Jan. 12, 1993

§ 102(e) Date: Jan. 12, 1993

[87] PCT Pub. No.: WO92/01525

PCT Pub. Date: Feb. 6, 1992

[30] Foreign Application Priority Data

Jul. 19, 1990 [GB] United Kingdom ..... 9015832

[51] Int. Cl.[6] ..... B22D 23/00

[52] U.S. Cl. ..... 266/44; 266/219; 266/216

[58] Field of Search ..... 266/44, 202, 216, 217, 266/219; 222/603

[56] References Cited

U.S. PATENT DOCUMENTS 3,831,857 8/1974 Scott ..... 222/603
3,951,577 4/1976 Okayama et al. ..... 266/202
4,066,117 1/1978 Clark et al. ..... 164/46
4,723,763 2/1988 Defrancq et al. ..... 266/159
4,901,784 2/1990 Ashok et al. ..... 164/429

FOREIGN PATENT DOCUMENTS 0198613 10/1986 European Pat. Off. .
0000456 10/1985 WIPO .

*Primary Examiner*—Scott Kastler
*Attorney, Agent, or Firm*—Brown, Martin, Haller & McClain

[57] ABSTRACT

An introducing means for introducing particulate material into a molten metal, molten alloy or molten ceramic stream, or spray of droplets formed therefrom is disclosed. The introducing means has an annular introducing chamber defining an opening through which the stream may be teemed. The chamber includes an inlet, and an outlet positioned about the opening. The outlet allows particulate material to exit from the introducing chamber at a plurality of positions about the opening so that, in use, the particulate material is introduced substantially uniformly about the stream or spray. The particulate material is preferably supplied by means of a hopper, a screw feeder for feeding material to the hopper to a mixing chamber, and a transport gas for transporting the particulate material from the mixing chamber to the introducing chamber.

7 Claims, 2 Drawing Sheets

1
2
3
4
6
8
10
12
13
14
16
17
18
20
21
22
23
26

DEVICE FOR INTRODUCING PARTICULATE MATERIAL

This invention relates to an introducing means for introducing powder or like particulate material into a molten metal, metal alloy or molten ceramic stream, or into a spray of molten droplets formed therefrom.

In our prior European Patent No. 198613, we have disclosed the introduction of solid particulate material, preferably into the 'atomizing zone' either just before or immediately after a stream of molten metal or metal alloy begins to break up into a spray. The solid particles may be introduced with and carried by the atomizing gas, or may be carried by a separate flow of gas, or gravity fed or vibration fed into the atomizing zone. If fine particles are to be introduced then the powder material may be fluidized to prevent clogging.

An object of the present invention is to provide an improved introducing means.

According to the present invention, there is provided an introducing means for introducing particulate material into a molten metal, molten alloy or molten ceramic stream, or spray of droplets formed therefrom, the introducing means comprising an introducing chamber having an opening through which a stream of molten metal, metal alloy or molten ceramic may be teemed, an inlet for particulate material to the introducing chamber and outlet means positioned about the opening for allowing particulate material to exit from the introducing chamber at a plurality of positions about the opening so that, in use, the particulate material is introduced substantially uniformly about the stream or spray.

Preferably, the introducing chamber is annular and the inlet opens tangentially into the introducing chamber. Suitably there are two inlets both opening tangentially into the introducing chamber, one disposed diametrically opposed to the other.

Particulate material may be either supplied by recycling overspray from the atomizing chamber as disclosed and claimed in our European Patent No. 198613, or may be supplied from a separate source. Preferably the source comprises a hopper for powder, a screw feeder for feeding powder from the hopper to a mixing chamber, means for introducing transport gas at the mixing chamber, and at least one transportation conduit from the mixing chamber to the inlet to the introducing chamber. In the described arrangement the source also includes means for maintaining an equal pressure in the hopper and the mixing chamber.

The invention also includes introducing means, for introducing particulate material into a stream or spray of molten metal, metal alloy or molten ceramic, comprising a hopper for particulate material, a screw feeder for feeding particulate material from the hopper to a mixing chamber, means for introducing transport gas at the mixing chamber, at least one transportation conduit from the mixing chamber for conducting transport gas and particulate material to an outlet at which the particulate material may be applied into a stream or spray for incorporation therein.

Suitably the outlet is an outlet from an annular introducing chamber, an inlet of which opens tangentially into the chamber. The annular introducing chamber preferably has a plurality of outlets from the chamber so that particulate material may be introduced substantially uniformly into a metal stream passed through the opening defined by the annular introducing chamber.

The invention also includes a method of introducing particulate material into a stream or spray of molten metal, metal alloy or molten ceramic comprising the steps of:

providing particulate material within a hopper, screw feeding particulate material from the hopper to a mixing chamber, mixing the particulate material at the mixing chamber with a transport gas, transporting the particulate material to an introducing chamber positioned about the stream or spray, and, causing the particulate material to issue from the introducing chamber substantially uniformly about the stream or spray so as to be incorporated therein.

The present invention has the advantage over fluidization methods in that the particulate flow rate governed by the screw feeder is substantially independent of gas flow rate.

BRIEF DESCRIPTION OF THE DRAWINGS

The invention will now be described by way of example with reference to the accompanying drawings in which.

Figure 1:
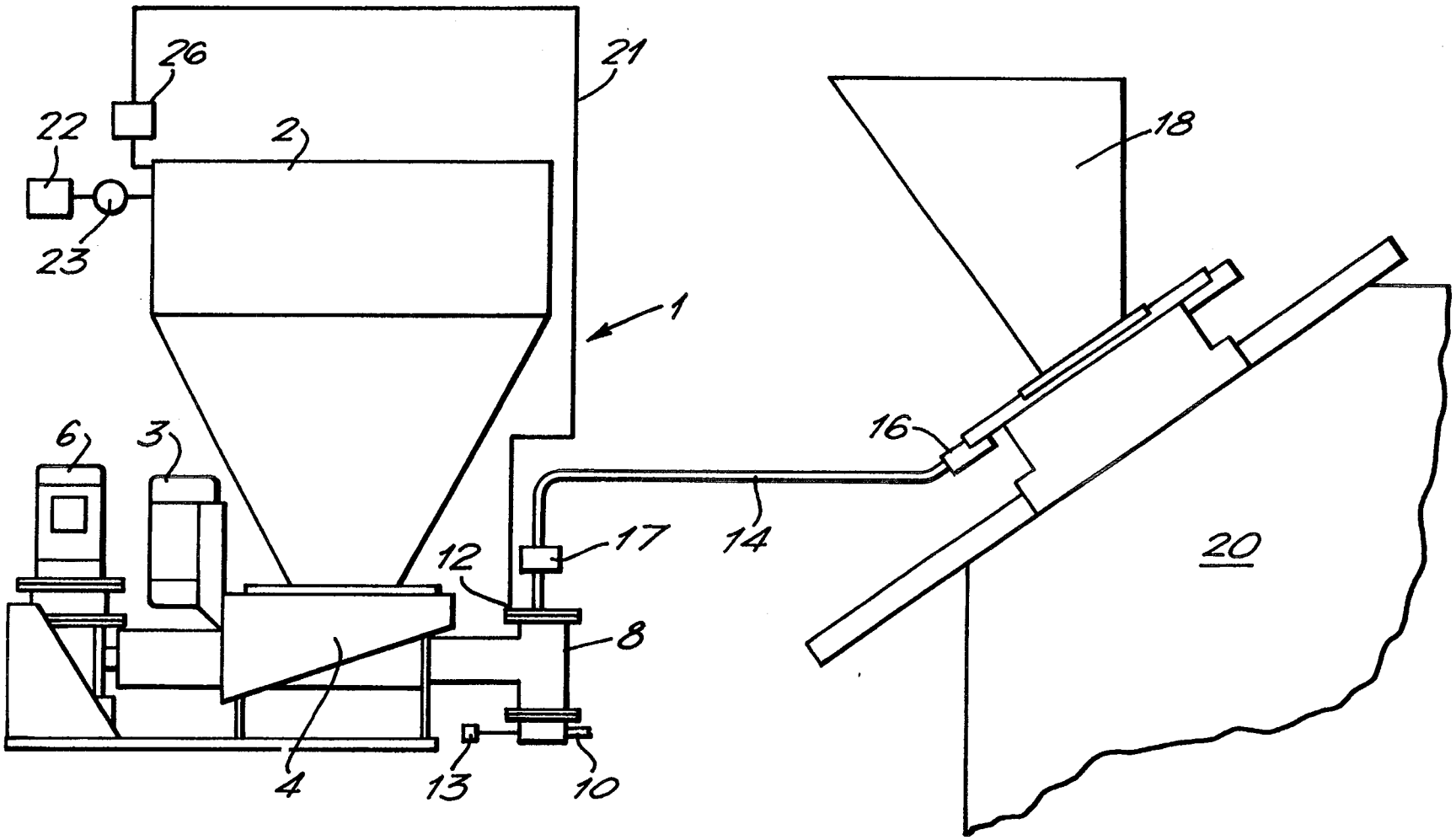
FIG. 1 is a schematic view of the general layout of the introducing means of the invention as applied to a spray chamber.

In the drawings an introducing means (1) for introducing particulate material into a transport gas stream comprises a powder hopper (2) and a vibrator (3). The powder hopper (2) is mounted above a trough (4), in the base of which runs a metering feed screw (5). The feed screw (5) is driven by a drive motor (6) and extends horizontally through one end of the trough and into a feed tube (7) from which particulate material may be discharged into a mixing chamber (8). The discharge rate of powder into the mixing chamber (8) is controlled by the screw speed and can be varied as desired. The vibrator (3) may be mounted on the trough (4) to ensure a steady flow of powder into the feed screw (5) from the hopper (2). A vibrator may also be provided on the feed tube (7) to ensure that the powder does not compact during operation.

Figure 2:
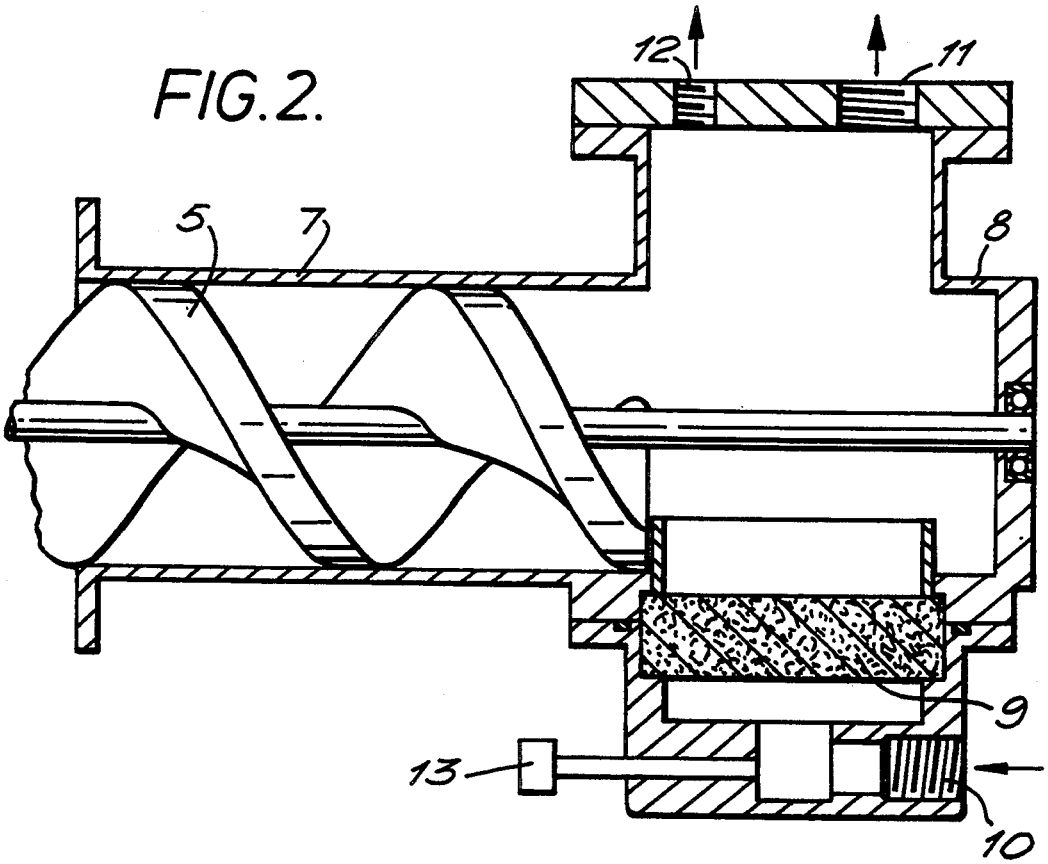
FIG. 2 is a cross-sectional view of the mixing chamber.

The mixing chamber (8) (shown in detail in FIG. 2) is mounted on the discharge end of feed tube (7). The chamber (8) includes a spreader plate (9) which is fed from the base by a transport gas inlet (10). The transport gas passes through the spreader plate (9) into the mixing chamber (8) and thence towards two exit ports (11) (only one showing) and carries with it particulate material exiting the feed tube (7). The exit ports (11) are positioned opposite the spreader plate (9) and particulate material exits in dilute phase flow with the transport gas. A third port (12) in the top of the mixing chamber is a pressure tapping to supply a control signal as will be explained. FIG. 2 also indicates a purge control valve (13) for introducing purge gas into the system as will also be explained.

Figure 3:
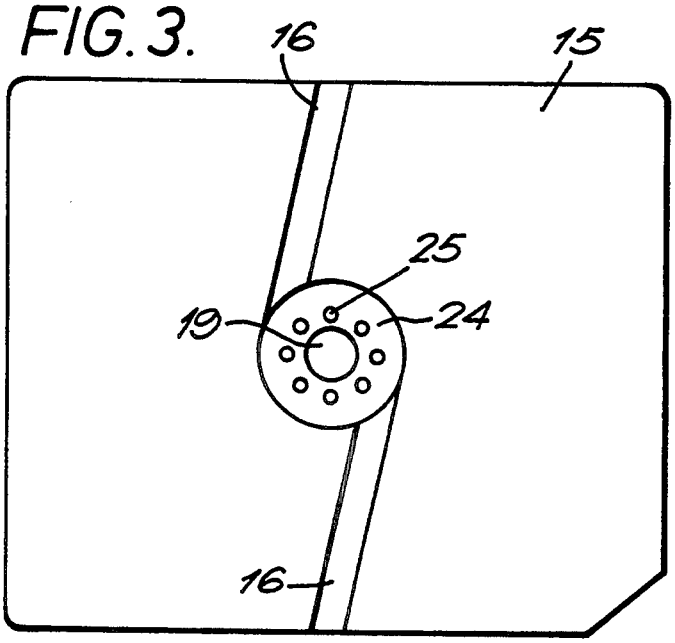
FIG. 3 is a plan view of an introducing chamber of the introducing means.

Leading from the exit ports (11) are transport pipes (14) through which the particulate material is transported to a introducing chamber body (15) shown in FIG. 3. The particulate material is carried in dilute phase flow with the transport gas from the mixing chamber (8) to respective inlet ports (16) in the introducing chamber body (15). The two transport pipes (14)

include shut-off valves (17) and are exactly the same length and are of similar geometry, and the particulate flow rate through the pipes is substantially the same so that the particulate material is substantially evenly distributed at the introducing chamber body (15).

The introducing chamber body (15) is positioned about the outlet nozzle of a tundish (18) and has a central opening (19) through which a liquid stream is teemed from the tundish (18) into an atomizing chamber (20). The inlet ports (16) in the introducing chamber body (15) are set tangentially to the axis of the opening (19) and introduce the particulate material into the plenum or introducing chamber (24) defined by the body (15). Suitably, the tangential arrangement causes the particulate material to swirl within the introducing chamber (24) and to be evenly distributed therein. The particulate material and gas exits through a plurality of injection ports (25) distributed evenly about the opening (19).

In use, the atomizing chamber (20) is purged with the transport pipes (14) closed by respective shut-off valves (17). The introducing means (1) is also purged with an inert purge gas which is caused to flow through purge control valve (13) to the mixing chamber (8). From the mixing chamber (8) the purge gas flows along the length of the screw (5) and into the hopper (2). The gas is then vented from the hopper via a vent valve (22) (FIG. 1). During the purge procedure the hopper is pressurized by means of a back pressure regulator (23) at the vent valve (22).

Once the apparatus has been purged, the shut-off valves (17) are opened and the purge and vent valves (13) and (22) respectively, closed. Transport gas is then fed to the mixing chamber (8) and the screw feed of powder begun. The transport gas thus picks up powder from the end of the feed tube (7) and flows along with the powder to the introducing chamber body (15). The flow of transport gas causes a back pressure to build up in the mixing chamber (8) which is compensated for by the prior pressurizing of the hopper (2) so as to eliminate any pressure drop across the screw (5). In this way, any gas flow from the mixing chamber (8) to the hopper (2) via the feed tube (7) which would otherwise disrupt the powder flow, is prevented. This pressure is regulated by means of a signal taken from the mixing chamber (8) at port (12) so that, as the powder flow increases increasing the back pressure, the hopper pressure increases to eliminate the pressure difference across the screw (5). This is indicated diagrammatically by line (21) and pressure regulator (26).

At the introducing chamber body (15) the transport gas and powder enter the introducing chamber (24) tangentially and swirl within the plenum chamber. The powder and gas then exit the introducing chamber (24) through a plurality of holes (25) equally spaced in an annulus about the central opening (19). At the same time, liquid metal from the tundish (18) is teemed through the central opening (19) for atomization in a known manner. The introduced powder, applied via the introducing chamber body (15) around the stream in a substantially uniform distribution, combines with the molten stream for atomization therewith to form molten droplets including introduced powder particles.

I claim:

1. Gas atomization apparatus for atomizing a molten metal, molten alloy or molten ceramic stream comprising atomizing means for receiving the stream and atomizing the stream into a spray of droplets, and introducing means for introducing particulate material into the stream or spray, the introducing means including an introducing chamber having an opening through which a stream of molten metal, metal alloy or molten ceramic may be teemed, an inlet for particulate material to the introducing chamber and outlet means positioned about the opening for allowing particulate material to exit from the introducing chamber at a plurality of positions about the opening so that, in use, the particulate material is introduced substantially uniformly about the stream or spray.

2. Gas atomization apparatus according to claim 1, wherein the introducing chamber is annular and the inlet opens tangentially into the introducing chamber.

3. Gas atomization apparatus according to claim 2, wherein there are two inlets both opening tangentially into the introducing chamber, one disposed diametrically opposed to the other.

4. Gas atomization apparatus according to any one of the preceding claims, wherein the outlet means comprises a plurality of discrete openings about the introducing chamber.

5. Gas atomization apparatus according to claim 1, further including a hopper for particulate material, a screw feeder for feeding particulate material from the hopper to a mixing chamber, means for introducing transport gas at the mixing chamber, and at least one transportation conduit from the mixing chamber to the inlet to the introducing chamber.

6. Gas atomization apparatus according to claim 5, further including means for maintaining an equal pressure in the hopper and the mixing chamber.

7. A method of gas atomizing a stream of molten metal, metal alloy or molten ceramic into a spray of droplets, comprising the steps of:

providing means for receiving the stream and atomizing the stream into a spray of droplets;

teeming the stream through said receiving and atomizing means;

providing particulate material within a hopper;

screw feeding particulate material from the hopper to a mixing chamber;

mixing the particulate material at the mixing chamber with a transport gas;

transporting the particulate material to an introducing chamber positioned about the stream or spray; and causing the particulate material to issue from the introducing chamber substantially uniformly about the stream or spray so as to be incorporated therein.

* * * * *